US011585218B2

(12) United States Patent
Wang et al.

(10) Patent No.: US 11,585,218 B2
(45) Date of Patent: Feb. 21, 2023

(54) DRILLING DEVICE FOR SURVEYING FRONT ROCK-MASS INTACTNESS OF TUNNEL FACE FOR TUNNEL CONSTRUCTED BY TBM AND METHOD USING THE SAME

(71) Applicant: China Institute of Water Resources and Hydropower Research, Beijing (CN)

(72) Inventors: Yujie Wang, Beijing (CN); Ruilang Cao, Beijing (CN); Yufei Zhao, Beijing (CN); Lipeng Liu, Beijing (CN); Qiang Shen, Beijing (CN); Jin Pi, Beijing (CN); Xingsong Sun, Beijing (CN); Shangxin Feng, Beijing (CN); Lifeng Zheng, Beijing (CN)

(73) Assignee: CHINA INSTITUTE OF WATER RESOURCES AND HYDROPOWER RESEARCH, Beijing (CN)

( * ) Notice: Subject to any disclaimer, the term of this patent is extended or adjusted under 35 U.S.C. 154(b) by 0 days.

(21) Appl. No.: 17/396,133

(22) Filed: Aug. 6, 2021

(65) Prior Publication Data

US 2022/0082020 A1 Mar. 17, 2022

(30) Foreign Application Priority Data

Sep. 17, 2020 (CN) ..... 202010981844.4

(51) Int. Cl.
*E21D 9/10* (2006.01)
*E21B 49/00* (2006.01)
(Continued)

(52) U.S. Cl.
CPC ..... *E21D 9/003* (2013.01); *E21B 7/046* (2013.01); *E21B 49/003* (2013.01); *E21F 17/18* (2013.01)

(58) Field of Classification Search
CPC .... E21B 49/003; E21B 49/005; E21B 49/006; E21B 7/046; E21D 9/003
See application file for complete search history.

(56) References Cited

U.S. PATENT DOCUMENTS 6,315,062 B1 * 11/2001 Alft ..... E21B 47/022 175/45
8,499,855 B2 * 8/2013 Lane ..... E21B 44/00 175/51
(Continued)

FOREIGN PATENT DOCUMENTS

CN 109630017 A * 4/2019
CN 110185383 A * 8/2019
(Continued)

*Primary Examiner* — Frederick L Lagman
(74) *Attorney, Agent, or Firm* — Bayramoglu Law Offices LLC

(57) ABSTRACT

A drilling device for surveying front rock-mass intactness of a tunnel face for a tunnel constructed by a TBM and a method using the same are provided. The drilling device includes a drilling assembly, a drill-attitude control assembly, a data monitoring assembly and a TBM-platform fixing seat. The drilling assembly is connected to a TBM hydraulic system to obtain power, to drill the rock mass by an alloy bit through rotation and translation thereof. The drill-attitude control assembly controls an angle, a direction and a position of a drill rod and maintains drilling accuracy and stability. The data monitoring assembly acquires and stores a drilling dynamic-response signal by a high-accuracy sensor and a data recorder, to analyze an intactness characteristic of the rock mass. The TBM-platform fixing seat mounts the drilling device on the TBM.

8 Claims, 5 Drawing Sheets

(51) Int. Cl.

| | |
|---|---|
| ***E21B 7/04*** | (2006.01) |
| ***E21D 9/00*** | (2006.01) |
| ***E21F 17/18*** | (2006.01) |

(56) References Cited

U.S. PATENT DOCUMENTS

| | | | | |
|---|---|---|---|---|
| 9,556,691 | B2 * | 1/2017 | Van Zee | E21B 21/12 |
| 2006/0076161 | A1 * | 4/2006 | Weaver | E21B 49/003 175/320 |
| 2018/0010437 | A1 * | 1/2018 | Reid | E21B 49/003 |

FOREIGN PATENT DOCUMENTS

| | | | | | |
|---|---|---|---|---|---|
| CN | 112943092 | A | * | 6/2021 | E21B 15/04 |
| CN | 113756713 | A | * | 12/2021 | |
| CN | 114000866 | A | * | 2/2022 | |
| JP | 2000034890 | A | * | 2/2000 | |
| KR | 102095678 | B1 | * | 3/2020 | E21B 15/04 |

* cited by examiner

DRILLING DEVICE FOR SURVEYING FRONT ROCK-MASS INTACTNESS OF TUNNEL FACE FOR TUNNEL CONSTRUCTED BY TBM AND METHOD USING THE SAME

CROSS REFERENCE TO RELATED APPLICATION

This patent application claims the benefit and priority of Chinese Patent Application No. 202010981844.4 filed on Sep. 17, 2020, the disclosure of which is incorporated by reference herein in its entirety as part of the present application.

TECHNICAL FIELD

The present disclosure relates to the field of tunnel and underground engineering technologies, and in particular to a device for surveying front rock-mass intactness of a tunnel face for a tunnel and a method using the same, which are applied to geological-prediction engineering of open-type and shield-type tunnel boring machines (TBMs).

BACKGROUND

At present, the TBM technology is widely used in the domestic field of tunnels and underground engineering, especially in the construction of deep and long tunnels. However, the TBM is more sensitive to the intactness of the rock mass. On the one hand, in rock mass with good intactness, the TBM is prone to the incapable excavation and the slow speed, so the hob strength and stiffness of the TBM is necessary to be selected reasonably according to the intactness characteristics of the rock mass; and on the other hand, in rock mass with poor intactness, if front geological conditions are unclear, the TBM is prone to occur problems such as machine jamming and engineering instability. Therefore, the survey of the front rock-mass intactness of the tunnel face for the tunnel constructed by the TBM is a very difficult point in construction.

The TBM is a huge mechanical electromagnet. In a test of the rock-mass intactness, geophysical methods used today are greatly disturbed, which leads to a great reduction in test accuracy and seriously affects an engineering application effect. However, in the rock mass with the poor intactness, a traditional drilling method often fails to make the test to be normally performed due to the hole collapse and the shrinkage. A large number of on-site drilling experiences indicate that there is a good correlation between monitoring data during the rock-mass drilling and the rock-mass quality; the drilling monitoring data reflect optimal aggregation during drilling the same intact rock mass; and the drilling data have optimal regularity during drilling different intact rock mass. In view of this, it is possible to analyze the rock-mass intactness characteristics by the drilling data, thereby greatly solving an engineering problem that the front rock-mass characteristics of the tunnel face for the tunnel constructed by the TBM are difficult to survey.

At present, a technology that a drilling device for surveying rock-mass intactness is mounted on a TBM platform has not been developed and applied. It is of great value to analyze the rock-mass quality by using the monitoring data during drilling, resulting in good economic and social benefits. Thus, it is urgent to develop a device for surveying front rock-mass intactness of a tunnel face for a tunnel and a method operating the same, which are applied to geological-prediction engineering of open-type and shield-type tunnel boring machines (TBMs), that is, a drilling device for surveying front rock-mass intactness of a tunnel face for a tunnel and a method using the same.

SUMMARY

An potential objective of the present disclosure is to provide a drilling device for surveying front rock-mass intactness of a tunnel face for a tunnel and a method using the same. The present disclosure uses a predictive drilling device with digital information technologies to acquire dynamic information of the drilling tool response during drilling, which can analyze the intactness of the front rock mass of the tunnel face for the tunnel constructed by the TBM, and provide important survey data for the efficient and safe tunneling of the TBM.

As a potential approach for satisfying the above objective, the present disclosure uses the technical solution as follows.

A drilling device for surveying front rock-mass intactness of a tunnel face for a tunnel constructed by a TBM is provided. The drilling device includes a drilling assembly, a drill-attitude control assembly, a data monitoring assembly and a TBM-drill-platform fixing seat, where the drilling assembly includes an alloy bit, a drill rod, a drill rotator, a drill rotator base and a supporting-plate slider; the alloy bit drills front rock mass of the tunnel face and is installed at a top of the drill rod; the drill rotator and the supporting-plate slider drive the drill rod to move, so as to enable the drill rod to generate rotation and translation; the drilling assembly is fixed to a slide-rail steel frame as a whole to maintain stability thereof; the slide-rail steel frame includes slide-rail jamming grooves and slide-rail ridges; the drill-attitude control assembly includes a front lifter, a middle lifter and a tail connector; the front lifter includes a front lifting fix-pin, a front lifting sleeve and a front lifting shaft; the middle lifter includes a middle lifting fix-pin, a middle lifting sleeve and a middle lifting shaft; the tail connector includes a slide-rail steel frame seat and a cylindrical pin; the data monitoring assembly includes a displacement inductor, a hydraulic sensor, a speed tester, a torque meter rotor, a torque meter stator and parts for installing and fixing; and the TBM-drill-platform fixing seat fixes the drilling device to a TBM-drill-platform frame by a front lifter base, a middle lifter base and a tail connection seat.

Further, stable back and forth movements of both the drill rotator base and the supporting-plate slider that are performed on the slide-rail ridges are realized by the slide-rail jamming grooves, and the back and forth movements are transmitted to the drill rod, so as to drive the alloy bit to drill the front rock mass.

Further, power of the rotation and the translation during drilling of a drill is supplied by a TBM hydraulic system; hydraulic pressure is sequentially transmitted to a hydraulic tank, a drill hydraulic adapter, a pipeline and hydraulic adapters by a TBM hydraulic input port to supply the power; and hydraulic sealing bolts, an adapter sealing gasket and hydraulic adapter bolts fix and seal the hydraulic tank, the drill hydraulic adapter, the pipeline and the hydraulic adapters.

Further, the displacement inductor records drilling footage of the alloy bit by inducting a relative distance thereof to a displacement inductor target in the translation.

Further, the torque meter rotor is moved coaxially along with the drill rod; the torque meter stator inducts a stress state of the torque meter rotor to measure drilling torque of the alloy bit; the speed tester coaxial with the drill rod records a rotation speed of the drill rod; and the torque meter stator and a speed tester seat are configured to fix the torque meter rotor and the speed tester, and to restrain the drill rod.

Further, the hydraulic sensor is installed at the pipeline by a hydraulic sensor connector and is compressed and sealed by fix bolts.

Further, a wireless signal receiver and a data recorder transmit and record monitoring data, and are in signal communication with a TBM data processing device by a signal transmission port and data transmission pins.

The present disclosure further provides a method of operating the drilling device for surveying front rock-mass intactness of a tunnel face for a tunnel, which may include: installing the TBM-drill-platform frame at a construction platform behind a TBM cutter head, adjusting the front lifting shaft and the middle lifting shaft in height, such that the alloy bit is moved to be tightly close to the front rock mass for performing hole drilling; coupling a TBM hydraulic input port to a TBM hydraulic system to provide continuous power for drilling, and coupling a signal transmission port and a TBM data transmission system; turning on the displacement inductor, the hydraulic sensor, the speed tester, the torque meter rotor and the torque meter stator to check whether or not data is normally output; starting the drilling assembly to move the drill rod forwards with predetermined torque and predetermined thrust, continuously drilling the front rock mass by the alloy bit, determining a drilling distance based on a value measured by the displacement inductor, and turning off the drilling assembly after drilling to a preset distance; extracting and storing information of data in a data recorder, acquiring and organizing the data comprising drilling time, a drilling displacement, drilling pressure, a drilling rotation speed and drilling torque in drilling, and calculating a value of a parameter A; and S6, after acquiring drilling monitoring data, obtaining a drilling speed by the drilling displacement and the drilling time, calculating an intactness index by $K=A3V3P^{-0.5}3N^{-0.5}3M^{-0.5}$, wherein the intactness index of intact rock mass is 0-2, the intactness index of blocky rock mass is 2-3, and the intactness index of extremely broken and hollow rock mass is greater than 3, determining the front rock-mass intactness based on the intactness index of each section in the hole drilling, and completing the drilling.

Compared with the prior art, the present embodiments may have the beneficial effects as follows. The drilling device for surveying front rock-mass intactness of a tunnel face for a tunnel of the present disclosure may have the high digitization and informatization quality, as well as the rapid, continuous and real-time exploration process. The parameter of the quality of the rock mass may be acquired by means of drilling dynamic-response information of the alloy bit, which is a method for acquiring in-situ engineering geological conditions. The intactness of the rock mass is calculated by using strict formulas, which overcomes uncertainty of the subjective judgment of traditional artificial observation. So, the structure design of the present disclosure may be flexible and adjustable, which can meet the usage of TBMs of different types and different diameters, and ensure safe and efficient construction of the TBMs.

DETAILED DESCRIPTION

Figure 1:
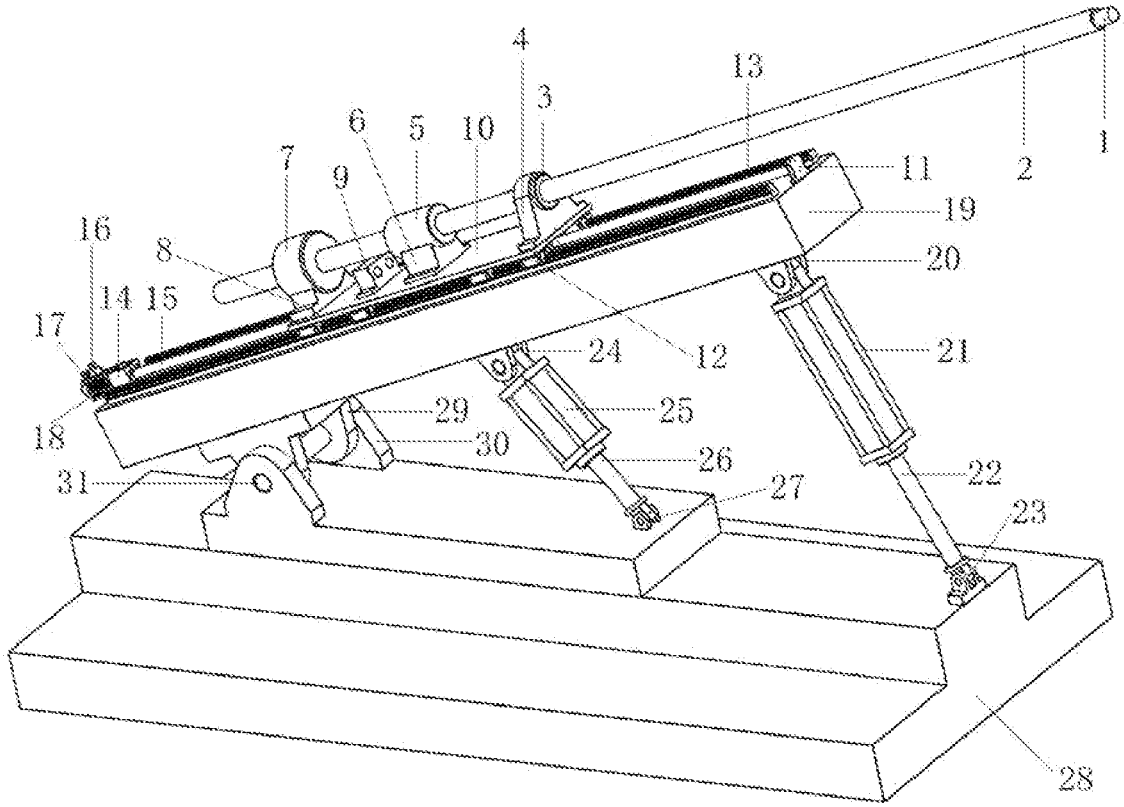
FIG. 1 is a perspective diagram of a drilling device for surveying front rock-mass intactness of a tunnel face for a tunnel constructed by a TBM according to an embodiment of the present disclosure.

The technical solutions in the present disclosure are clearly and completely described below with reference to the drawings of the present disclosure. It should be understood that the embodiments described below are merely a part rather than all of the embodiments of the present disclosure. All other embodiments obtained by those skilled in the art based on the embodiments of the present disclosure without creative efforts shall fall within the protection scope of the present disclosure.

As shown in FIGS. 1-5, a drilling device for surveying front rock-mass intactness of a tunnel face for a tunnel constructed by a TBM of the present disclosure may include a drilling assembly, a drill-attitude control assembly, a data monitoring assembly and a TBM-drill-platform fixing seat.

As shown in FIGS. 1-4, the drilling assembly may include an alloy bit 1, a drill rod 2, a supporting-plate slider 10, a pipeline 15, a TBM hydraulic input port 16, a hydraulic adapter 35, hydraulic adapter bolts 36, hydraulic sealing bolts 37, a hydraulic tank 38, a drill hydraulic adapter 39, fixing bolts 40, an adapter sealing gasket 41 and screws 42. The drilling assembly may drill the rock mass in front of the tunnel face by means of the alloy bit 1. The alloy bit 1 may be installed at a top of the drill rod 2. A drill rotator 7 and the supporting-plate slider 10 may drive the drill rod 2 to move, so as to enable the drill rod 2 to generate rotation and translation. The drilling assembly may be fixed to a slide-rail steel frame 19 as a whole to maintain the stability thereof. Stable back and forth movement of a drill rotator base 8 and the supporting-plate slider 10 that are performed on the slide-rail ridges may be realized by means of slide-rail jamming grooves 12, and the back and forth movement is transmitted to the drill rod 2, so as to drive the alloy bit 1 to drill the rock mass to be explored. The power of the rotation and the translation during drilling may be supplied by a TBM hydraulic system. Hydraulic pressure may be sequentially transmitted to the hydraulic tank 38, the drill hydraulic adapter 39, the pipeline 15 and the hydraulic adapter 35 by means of the TBM hydraulic input port 16 to supply the power. The hydraulic sealing bolts 37, the adapter sealing gasket 41 and the hydraulic adapter bolts 36 may fix and seal the assembly, i.e., the hydraulic tank, the drill hydraulic adapter, the pipeline and the hydraulic adapters.

Figure 2:
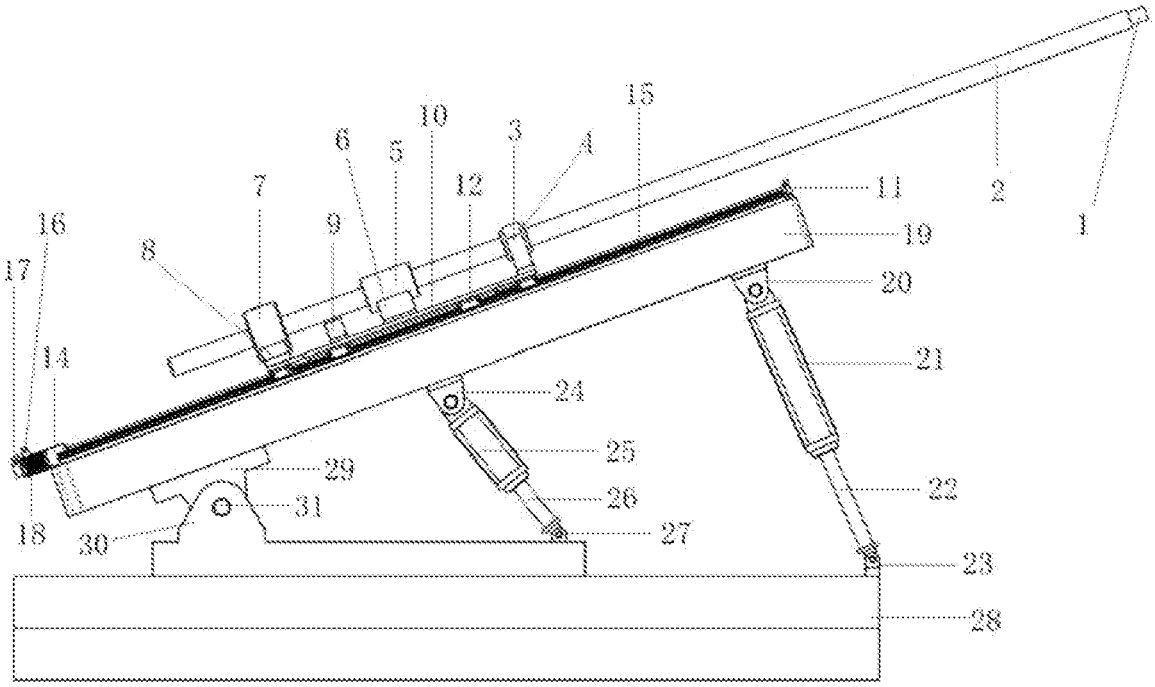
FIG. 2 is an elevation showing a structure of the drilling device according to an embodiment of the present disclosure.
Figure 3:
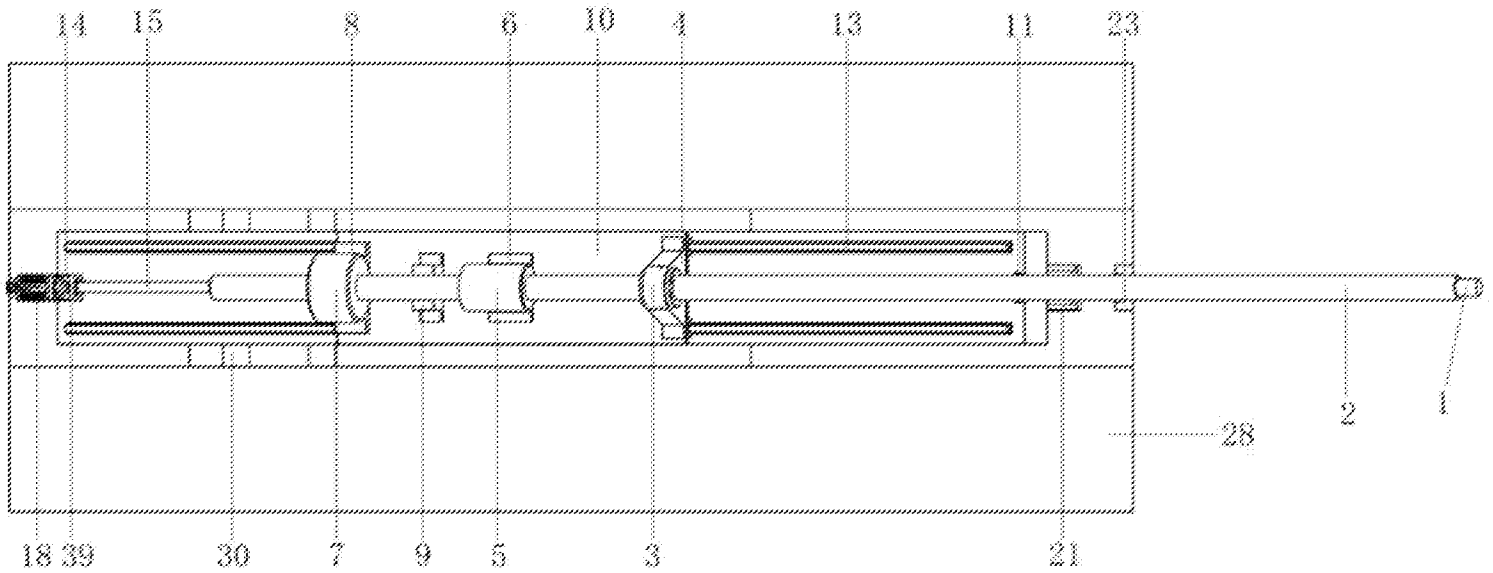
FIG. 3 is a plan view of the structure of the drilling device according to an embodiment of the present disclosure.
Figure 4:
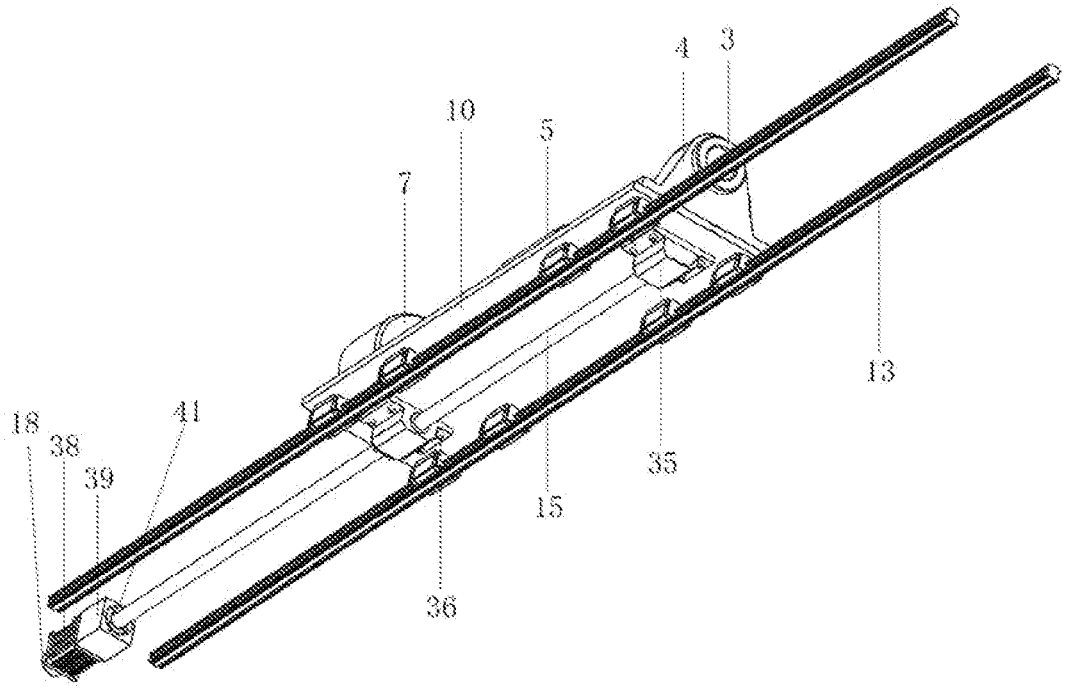
FIG. 4 is an assembly diagram of a drilling assembly and a drill-attitude control assembly according to an embodiment of the present disclosure.

As shown in FIGS. 1-3, the drill-attitude control assembly may include the slide-rail jamming grooves 12, the slide-rail ridges 13, the slide-rail steel frame 19, a front lifting fix-pin 20, a front lifting sleeve 21, a front lifting shaft 22, a middle lifting fix-pin 24, a middle lifting sleeve 25, a middle lifting shaft 26, a slide-rail steel frame seat 29 and a cylindrical pin 31. The drill-attitude control assembly may include a front lifter, a middle lifter and a tail connector, to move the alloy bit 1 flexibly and to change a drilling position thereof. The front lifter may include the front lifting fix-pin 20, the front lifting sleeve 21 and the front lifting shaft 22. The middle lifter may include the middle lifting fix-pin 24, the middle lifting sleeve 25 and the middle lifting shaft 26. The tail connector may include the slide-rail steel frame seat 29 and the cylindrical pin 31. The drill-attitude control assembly may adjust the front lifting shaft 22 and the middle lifting shaft 26 to adjust a direction of the drill rod 2, so as to control a drilling angle and a drilling position of the alloy bit 1.

Figure 5:
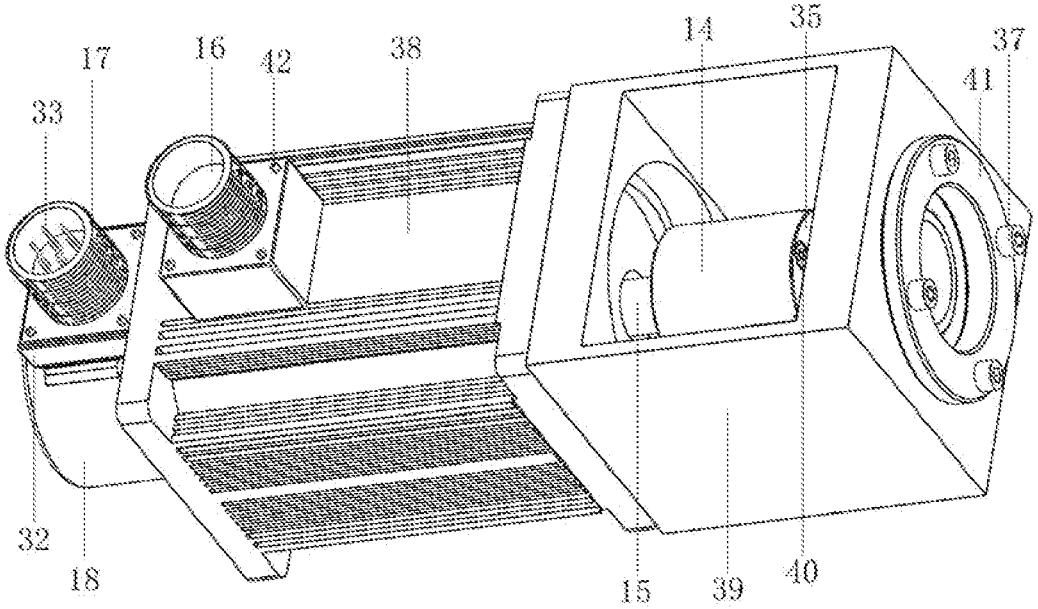
FIG. 5 is an installation diagram of an interface of both the drilling device and a TBM platform according to an embodiment of the present disclosure.
Figure 6:
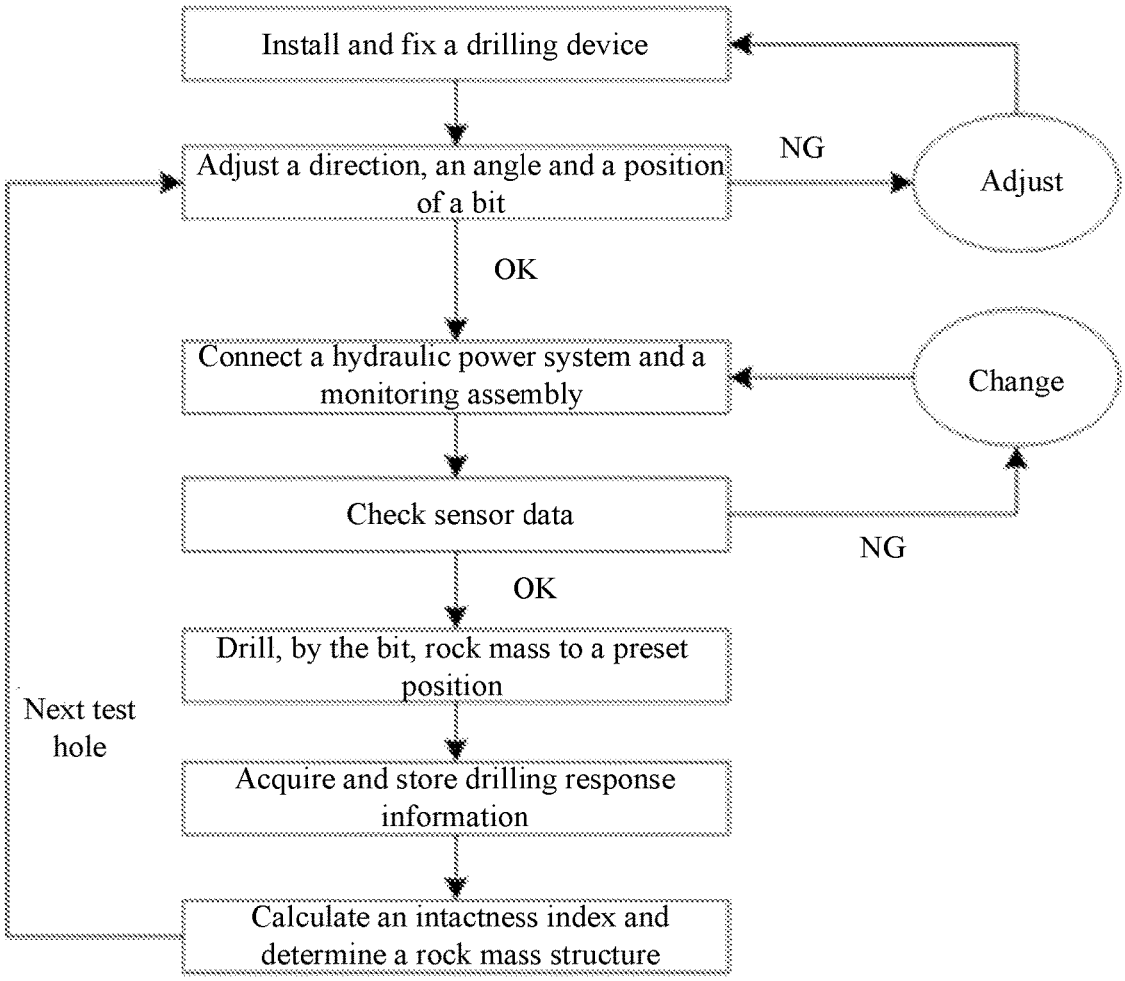
FIG. 6 is a flow diagram of a method of using the drilling device according to an embodiment of the present disclosure.
Figure 7:
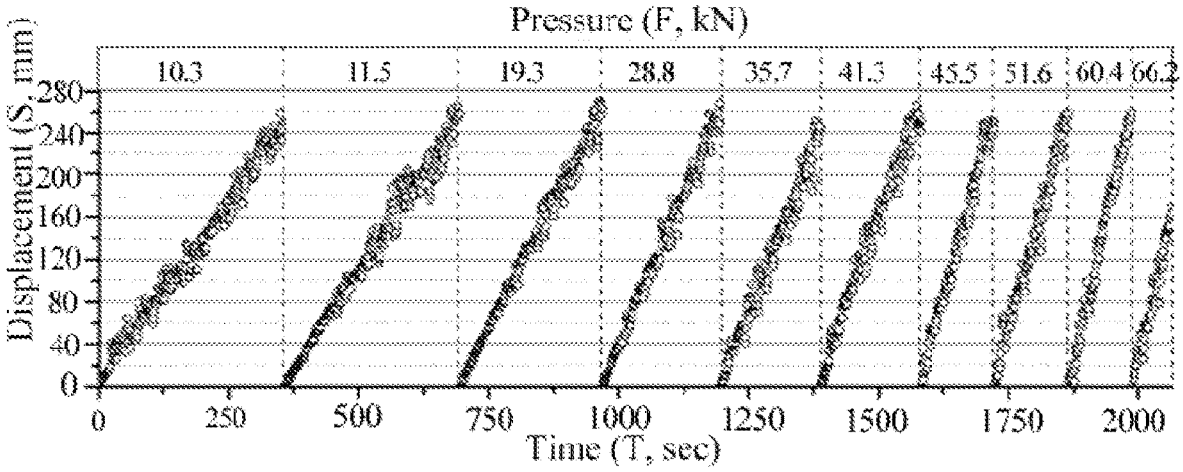
FIG. 7 is a monitoring curve graph of the drilling device in intact rock mass according to an embodiment of the present disclosure.
Figure 8:
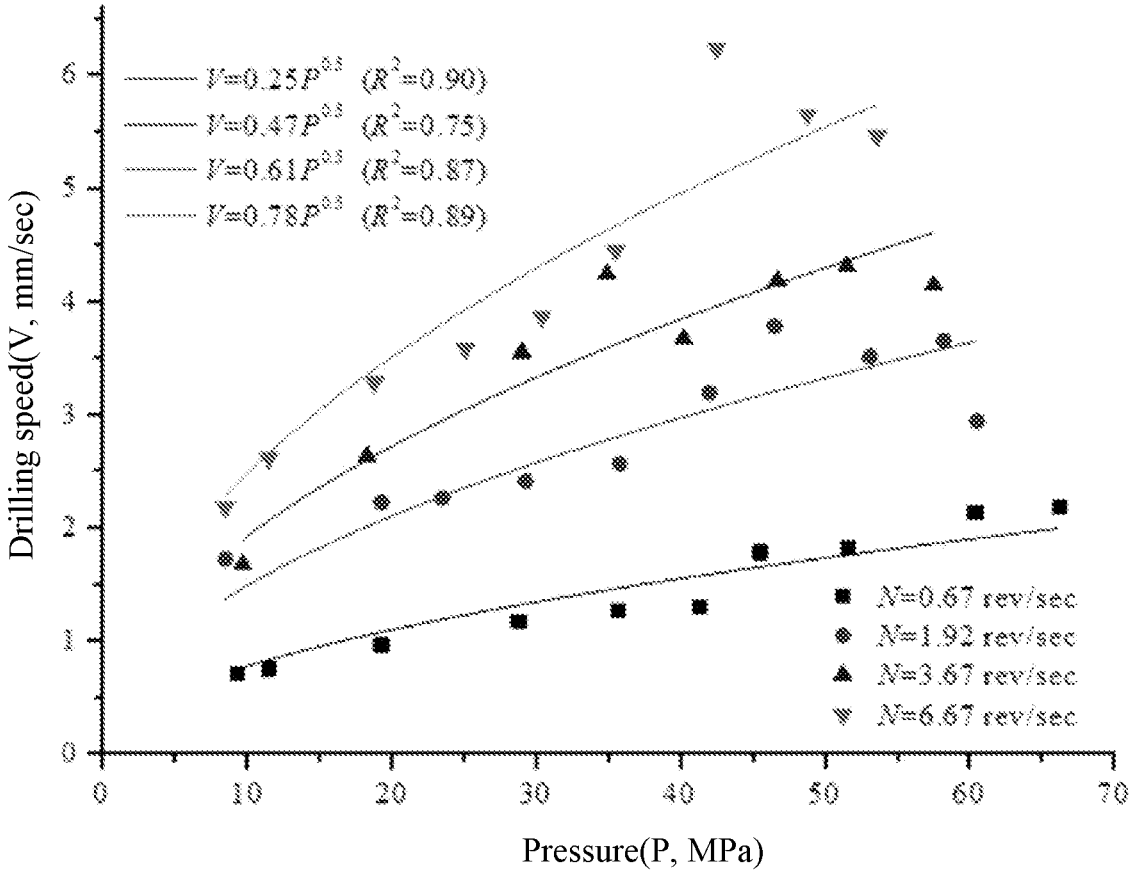
FIG. 8 is a graph of a drilling response parameter correlation and curve fitting according to an embodiment of the present disclosure.
Figure 9:
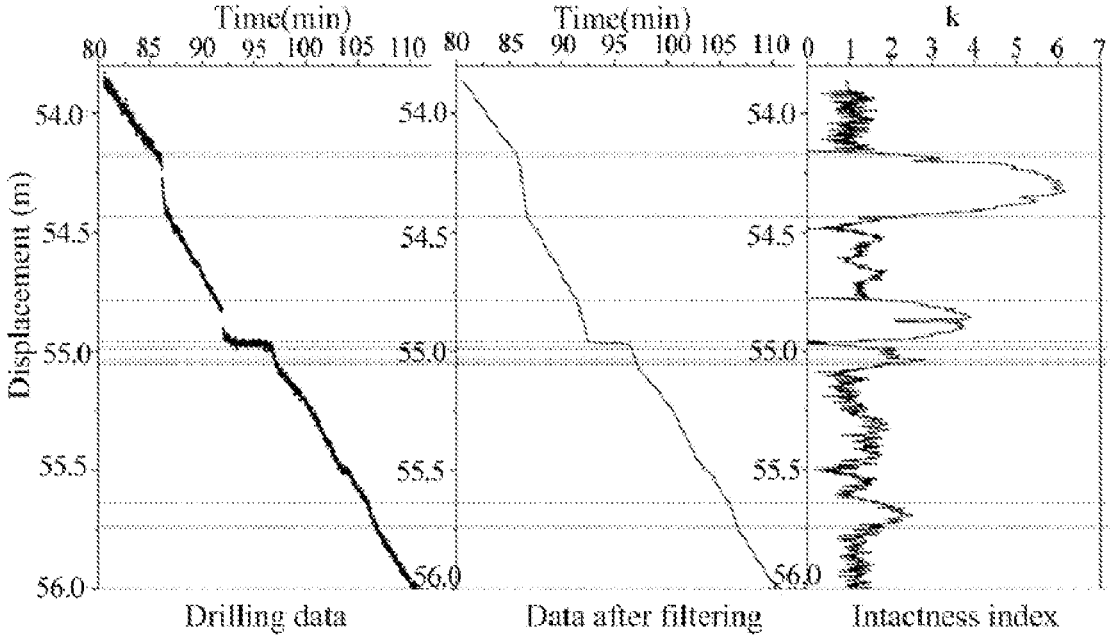
FIG. 9 is a schematic diagram of data curve fluctuation according to an embodiment of the present disclosure.

As shown in FIGS. 1-4, the data monitoring assembly may include a torque meter rotor 3, a torque meter stator 4, a speed tester 5, a speed tester seat 6, the drill rotator 7, the drill rotator base 8, a displacement inductor, a displacement inductor target 11, a hydraulic sensor 14, a signal transmission port 17, a data recorder 18, a wireless signal receiver 32, data transmission pins 33 and a hydraulic sensor connector 34. The data monitoring assembly may include the displacement inductor 9, the hydraulic sensor 14, the speed tester 5, the torque meter rotor 3, the torque meter stator 4 and other parts for installing and fixing. The displacement inductor 9 may record drilling footage of the alloy bit 1 by inducting a relative distance of the displacement inductor to the displacement inductor target 11 in a translation process. The torque meter rotor 3 may move coaxially along with the drill rod 2. The torque meter stator 4 may induct a stress state of the torque meter rotor 3 to measure drilling torque of the alloy bit 1. The speed tester 5 coaxial with the drill rod 2 may record a rotation speed of the drill rod. The torque meter stator 4 and the speed tester seat 6 may be configured to fix the torque meter rotor 3 and the speed tester 5, and to restrain the drill rod 2. The hydraulic sensor 14 may be installed at the pipeline 15 by means of the hydraulic sensor connector 34 and may be compressed and sealed by means of the fixing bolts 40. As shown in FIG. 5, monitoring data signal is transmitted by the wireless signal receiver 32 and the data recorder 18, and monitoring data message carried by this signal is recorded by the wireless signal receiver 32 and the data recorder 18. Furthermore, the wireless signal receiver 32 and the data recorder 18 may be in signal communication with a TBM data processing device by the signal transmission port 17 and the data transmission pins 33.

As shown in FIGS. 1-4, the TBM-drill-platform fixing seat may include a front lifter base 23, a middle lifter base 27, a TBM-drill-platform frame 28 and a tail connection seat 30. The TBM-drill-platform fixing seat may firmly fix the drilling device to the TBM-drill-platform frame 28 by means of the front lifter base 23, the middle lifter base 27 and the tail connection seat 30. An installation distance between the front lifter base 23 and the middle lifter base 27 may be set to control a size of the drilling device, so that requirements of TBMs of various specifications may be met.

As shown in FIGS. 6-9, the present disclosure further provides a method of using the drilling device for surveying the front rock-mass intactness of the tunnel face for the tunnel constructed by the TBM, which may include steps as follows.

In step S1, the TBM-drill-platform frame 28 is installed at a construction platform behind a TBM cutter head; the front lifting shaft 22 and the middle lifting shaft 26 may be adjusted in height, so that a deviation between a direction of the drill rod 2 and a preset angle should not be greater than ±3°; and the alloy bit 1 may be moved to be tightly close to rock mass to be explored for performing hole drilling, where a position deviation should not be greater than ±30 mm. If the direction of the drill rod 2 is influenced by position adjustment of the alloy bit 1, the direction of the drill rod 2 and a position of the alloy bit 1 should be adjusted repeatedly until the angle and the direction both meet engineering requirements. After the adjustment, the front lifter and the middle lifter may be fixed, so that the supporting-plate slider 10 can move smoothly along the slide-rail ridges, and not deflect under the drilling stress.

In step S2, the TBM hydraulic input port 6 may be coupled to a TBM hydraulic system to provide continuous power for drilling, where a hydraulic level may be adjusted to control drilling force to meet an actual drilling requirement of the rock mass with different strength; and the signal transmission port 17 may be coupled to a TBM data transmission system. The data transmission pins 33 must match with TBM data reception pins, and a data signal may be transmitted to a TBM information management platform for the data query, analysis and backup.

In step S3, the displacement inductor 9, the hydraulic sensor 14, the speed tester 5, the torque meter rotor 3 and the torque meter stator 4 may be turned on to check whether or not data are normally output. All the data should be synchronized, and the sampling frequency may be 1 set/s. The values indicated by the displacement inductor 9 and the speed tester 5 should be reset to zero after the drilling device is fixed. In a drilling process, changes of indicating values of the torque meter rotor 3, the torque meter stator 4 and the hydraulic sensor 14 may be observed, so as to control the drilling thrust to match a preset value. In case of abnormal sensing data, it should be checked whether or not there is any damage, and the sensor should be changed in time.

In step S4, the drilling assembly may be started to move the drill rod 2 forwards with predetermined torque and thrust; the alloy bit 1 may continuously drill the rock mass, where if the alloy bit 1 suffers obvious wear and tear, the alloy bit should be changed in time to avoid anomaly of monitoring data caused by problems of drilling tools; during drilling of the drilling device, drilling footage may be preset, a drilling distance may be determined according to a value measured by the displacement inductor 9; and the drilling assembly may be turned off after drilling to a preset distance. In a case where the preset drilling footage is not reached and the drilling is temporarily stopped, when the drilling is conducted again, the data recorded by the data recorder 18 can be automatically connected to keep data continuity of the displacement inductor 9.

In step S5, data information in the data recorder 18 may be extracted and stored, data including drilling time T with an unit of s, drilling displacement S with an unit of m, drilling pressure P with an unit of Pa, a drilling rotation speed N with an unit of rev/s and drilling torque M with an unit of N·m may be acquired and organized, where if abnormal data appear, an alarm should be given and the abnormal data should be eliminated, and data noise may be filtered rationally through a filtering method, to make the data clearer under not losing signal regularity; and for the same drilling device, a parameter A that is constant is unique, and a value of the parameter A may also be calculated according to an actual drilling situation.

In step S6, after drilling monitoring data are acquired, the drilling displacement S with an unit of m and the drilling time T with an unit of s are configured to obtain a drilling speed V with an unit of m/s, and an intactness index is calculated by a formula $K=A3V3P^{-0.5}3N^{-0.5}3M^{-0.5}$. A structural characteristic of the rock mass may be quickly evaluated by the intactness index. The intactness index K of intact rock mass is 0-2, the intactness index K of blocky rock mass is 2-3, and the intactness index K of extremely broken and hollow rock mass is greater than 3. The intactness of the rock mass is determined according to the intactness index K of each section of the hole drilling, so as to form a record table or a color histogram, and then the drilling is completed.

In addition, this specification should be regarded as a whole. The above implementations are not unique independent technical solution of the present disclosure. The technical solution in the embodiments can be appropriately combined and regulated to arrive at other implementations understandable by a person skilled in the art.

What is claimed is:

1. A drilling device for surveying front rock-mass intactness of a tunnel face for a tunnel constructed by a TBM (tunnel boring machine), the drilling device comprising:

a drilling assembly, a drill-attitude control assembly, a data monitoring assembly, and a TBM-drill-platform fixing seat, wherein the drilling assembly comprises an alloy bit, a drill rod, a drill rotator, a drill rotator base and a supporting-plate slider;

the alloy bit drills a front rock mass of the tunnel face and is installed at a front end of the drill rod;

the drill rotator and the supporting-plate slider drive the drill rod to move, so as to enable the drill rod to generate rotation and translation;

the drilling assembly is fixed to a slide-rail steel frame as a whole to maintain stability thereof;

the slide-rail steel frame comprises slide-rail jamming grooves and slide-rail ridges;

the drill-attitude control assembly comprises a front lifter, a middle lifter and a tail connector;

the front lifter comprises a front lifting fix-pin, a front lifting sleeve and a front lifting shaft;

the middle lifter comprises a middle lifting fix-pin, a middle lifting sleeve and a middle lifting shaft;

the tail connector comprises a slide-rail steel frame seat and a cylindrical pin;

the data monitoring assembly comprises a displacement inductor, a hydraulic sensor, a speed tester, a torque meter rotor, a torque meter stator; and the TBM-drill-platform fixing seat fixes the drilling device to a TBM-drill-platform frame by a front lifter base, a middle lifter base and a tail connection seat.

2. The drilling device for surveying the front rock-mass intactness of the tunnel face for the tunnel constructed by the TBM according to claim 1, wherein stable back and forth movements of both the drill rotator base and the supporting-plate slider that are performed on the slide-rail ridges are realized by the slide-rail jamming grooves, and the back and forth movements are transmitted to the drill rod, so as to drive the alloy bit to drill the front rock mass.

3. The drilling device for surveying the front rock-mass intactness of the tunnel face for the tunnel constructed by the TBM according to claim 1, wherein power of the rotation and the translation during drilling of a drill is supplied by a TBM hydraulic system;

hydraulic pressure is sequentially transmitted to a hydraulic tank, a drill hydraulic adapter, a pipeline and hydraulic adapters by a TBM hydraulic input port to supply the power; and hydraulic sealing bolts, an adapter sealing gasket and hydraulic adapter bolts fix and seal the hydraulic tank, the drill hydraulic adapter, the pipeline and the hydraulic adapters.

4. The drilling device for surveying the front rock-mass intactness of the tunnel face for the tunnel constructed by the TBM according to claim 1, wherein the displacement inductor records drilling footage of the alloy bit by inducting a relative distance thereof to a displacement inductor target in the translation.

5. The drilling device for surveying the front rock-mass intactness of the tunnel face for the tunnel constructed by the TBM according to claim 1, wherein the torque meter rotor is moved coaxially along with the drill rod; the torque meter stator inducts a stress state of the torque meter rotor to measure drilling torque of the alloy bit;

the speed tester coaxial with the drill rod records a rotation speed of the drill rod; and the torque meter stator and a speed tester seat are configured to fix the torque meter rotor and the speed tester, and to restrain the drill rod.

6. The drilling device for surveying the front rock-mass intactness of the tunnel face for the tunnel constructed by the TBM according to claim 1, wherein the hydraulic sensor is installed at the pipeline by a hydraulic sensor connector and is compressed and sealed by fix bolts.

7. The drilling device for surveying the front rock-mass intactness of the tunnel face for the tunnel constructed by the TBM according to claim 1, wherein a wireless signal receiver and a data recorder transmit and record monitoring data, and are in signal communication with a TBM data processing device by a signal transmission port and data transmission pins.

8. A method of using the drilling device for surveying the front rock-mass intactness of the tunnel face for the tunnel constructed by the TBM according to claim 1, the method comprising:

installing the TBM-drill-platform frame at a construction platform behind a TBM cutter head, adjusting the front lifting shaft and the middle lifting shaft in height, such that the alloy bit is moved to be tightly close to the front rock mass for performing hole drilling;

coupling a TBM hydraulic input port to a TBM hydraulic system to provide continuous power for drilling, and coupling a signal transmission port and a TBM data transmission system;

turning on the displacement inductor, the hydraulic sensor, the speed tester, the torque meter rotor and the torque meter stator to check whether or not data is normally output;

starting the drilling assembly to move the drill rod forwards with predetermined torque and predetermined thrust, continuously drilling the front rock mass by the alloy bit, determining a drilling distance based on a value measured by the displacement inductor, and turning off the drilling assembly after drilling to a preset distance;

extracting and storing information of data in a data recorder, acquiring and organizing the data comprising drilling time, a drilling displacement, drilling pressure, a drilling rotation speed and drilling torque in drilling, and calculating a value of a parameter A; and after acquiring drilling monitoring data, obtaining a drilling speed (V, m/s) by the drilling displacement and the drilling time;

calculating an intactness index;

determining the front rock-mass intactness based on the intactness index of each section of the front rock mass in the hole drilling, and completing the drilling.

* * * * *